US010759561B2

(12) United States Patent
Jurcak

(10) Patent No.: US 10,759,561 B2
(45) Date of Patent: Sep. 1, 2020

(54) MOLDED PLASTIC PALLET HAVING A SNAP IN SIGNAL TRANSMITTER AND METHOD OF MAKING SAME

(71) Applicant: Shuert Technology, LLC, Sterling Heights, MI (US)

(72) Inventor: Jeffrey C. Jurcak, Shelby Township, MI (US)

(73) Assignee: Shuert Technology, LLC, Sterling Heights, MI (US)

( * ) Notice: Subject to any disclaimer, the term of this patent is extended or adjusted under 35 U.S.C. 154(b) by 0 days.

(21) Appl. No.: 16/721,307

(22) Filed: Dec. 19, 2019

(65) Prior Publication Data

US 2020/0122884 A1 Apr. 23, 2020

Related U.S. Application Data

(63) Continuation-in-part of application No. 16/220,478, filed on Dec. 14, 2018.

(60) Provisional application No. 62/599,125, filed on Dec. 15, 2017.

(51) Int. Cl.
*B65D 19/00* (2006.01)
*B65D 19/38* (2006.01)

(52) U.S. Cl.
CPC ..... *B65D 19/0012* (2013.01); *B65D 19/38* (2013.01); *B65D 2519/00034* (2013.01); *B65D 2519/00069* (2013.01); *B65D 2519/00273* (2013.01); *B65D 2519/00407* (2013.01); *B65D 2519/00567* (2013.01)

(58) Field of Classification Search
CPC ..... B65D 19/0018; B65D 19/0065; B65D 19/38; B65D 2203/10
See application file for complete search history.

(56) References Cited

U.S. PATENT DOCUMENTS

| | | | |
|---|---|---|---|
| 3,044,606 | A | 7/1962 | Frosh |
| 5,191,972 | A | 3/1993 | Helzer et al. |
| 5,552,240 | A | 9/1996 | Derstine |
| 5,662,048 | A | 9/1997 | Kralj et al. |
| 6,042,962 | A | 3/2000 | Ling |
| 6,386,118 | B1 | 5/2002 | Bendit et al. |
| 6,483,434 | B1 | 11/2002 | UmiKer |
| 7,388,492 | B2 | 6/2008 | Watanabe |
| 8,077,040 | B2 | 12/2011 | Muirhead |
| 8,210,107 | B2 | 7/2012 | Muirhead |
| 9,038,546 | B2 | 5/2015 | Ten Bok |
| 9,230,227 | B2 | 1/2016 | Muirhead |
| 9,376,234 | B2 | 6/2016 | Linares |
| 10,270,070 | B2 | 4/2019 | Cadio |
| 2002/0000387 | A1 | 1/2002 | Krull et al. |

(Continued)

FOREIGN PATENT DOCUMENTS

| | | | |
|---|---|---|---|
| EP | 1382533 | A2 | 1/2004 |
| FR | 2697801 | A1 | 5/1994 |

(Continued)

*Primary Examiner* — Hanh V Tran
(74) *Attorney, Agent, or Firm* — Young Basile Hanlon & MacFarlane, P.C.

(57) ABSTRACT

A twin-sheet, thermoformed pallet is configured with a bottom-opening recess shaped to receive and hold in place a signal transmitting device. The recess has undercuts that allow the device to be snapped in and held against the floor of the recess and well above the bottom surface of the pallet body. The recess is provided with access for a tool to pry the device out for replacement or servicing.

11 Claims, 9 Drawing Sheets

(56) References Cited

U.S. PATENT DOCUMENTS

| | | | |
|---|---|---|---|
| 2002/0030597 | A1 | 3/2002 | Muirhead |
| 2003/0007666 | A1 | 1/2003 | Stewartson et al. |
| 2005/0076816 | A1 | 4/2005 | Nakano |
| 2006/0075939 | A1 | 4/2006 | Shuert |
| 2007/0296597 | A1 | 12/2007 | Nizzola |
| 2008/0042378 | A1 | 2/2008 | Dick et al. |
| 2008/0210140 | A1 | 9/2008 | Valentinsson |
| 2010/0084289 | A1 | 4/2010 | Willms et al. |
| 2010/0288843 | A1 | 11/2010 | Arnesen et al. |
| 2011/0042880 | A1 | 2/2011 | Konrad et al. |
| 2015/0118534 | A1 | 4/2015 | Rolfs et al. |
| 2015/0246749 | A1 | 9/2015 | Huber |
| 2015/0296332 | A1 | 10/2015 | Lee et al. |
| 2015/0298854 | A1 | 10/2015 | Linares |
| 2016/0003956 | A1 | 1/2016 | Walker et al. |
| 2016/0114936 | A1 | 4/2016 | Muirhead |

FOREIGN PATENT DOCUMENTS

| | | | |
|---|---|---|---|
| FR | 2706422 | B1 | 7/1995 |
| JP | 06064647 | A | 3/1994 |

MOLDED PLASTIC PALLET HAVING A SNAP IN SIGNAL TRANSMITTER AND METHOD OF MAKING SAME

CROSS-REFERENCE TO RELATED APPLICATIONS

This application is a continuation-in-part of U.S. patent application Ser. No. 16/220,478 filed Dec. 14, 2018 and claims in part the priority date of that application and U.S. Provisional Application Ser. No. 62/599,125 filed on Dec. 15, 2017; the contents of which are incorporated herein by reference.

SUMMARY

This application discloses a twin sheet thermoformed plastic pallet having a recess formed in a bottom surface to receive and hold a signaling device such as a GPS transponder. The recess in the pallet bottom is formed during the thermoforming process using an insert and is shaped to generally conform to the outside surface shape of the transponder. The recess has retainer tabs with shapes that allow the transponder to be installed far enough into the recess so that the transponder surface above the pallet bottom surface where it is is protected against inadvertent damage from objects engaging the pallet bottom surface. One or more slots or other details are formed in the recess wall or walls to allow access of a pry tool such that the transponder can be removed for service and/or replacement.

BRIEF DESCRIPTION OF THE INVENTION

The invention described herein is the combination of a locator transponder with a molded plastic pallet having a top load-bearing surface and bottom surface with support legs extending therefrom to allow forklift entry. Formed in the bottom surface of the pallet is a recess which shaped to receive and conform to the side surfaces of a signal transmitter such as a GPS transponder. The recess has one or more retainer structures such as tabs formed on the wall or walls of the recess so that the transponder can be snapped into the recess above the retainers to be held firmly in place. The recess is also provided with one or more access slots or openings to allow entry of a pry tool so that the transponder can be removed for service and/or replacement. The depth of the recess and the locations of the retainers is such that the exposed surface of the transponder is well within the recess where it is protected against inadvertent damage as the pallet is moved about with a forklift truck and settled on various surfaces.

BRIEF DESCRIPTION OF THE DRAWINGS

The features of the present invention will be best understood from the within detailed description of an embodiment thereof selected for purposes of illustration and shown in the accompanying drawings in which.

DETAILED DESCRIPTION OF THE ILLUSTRATIVE EMBODIMENT

Figure 1:
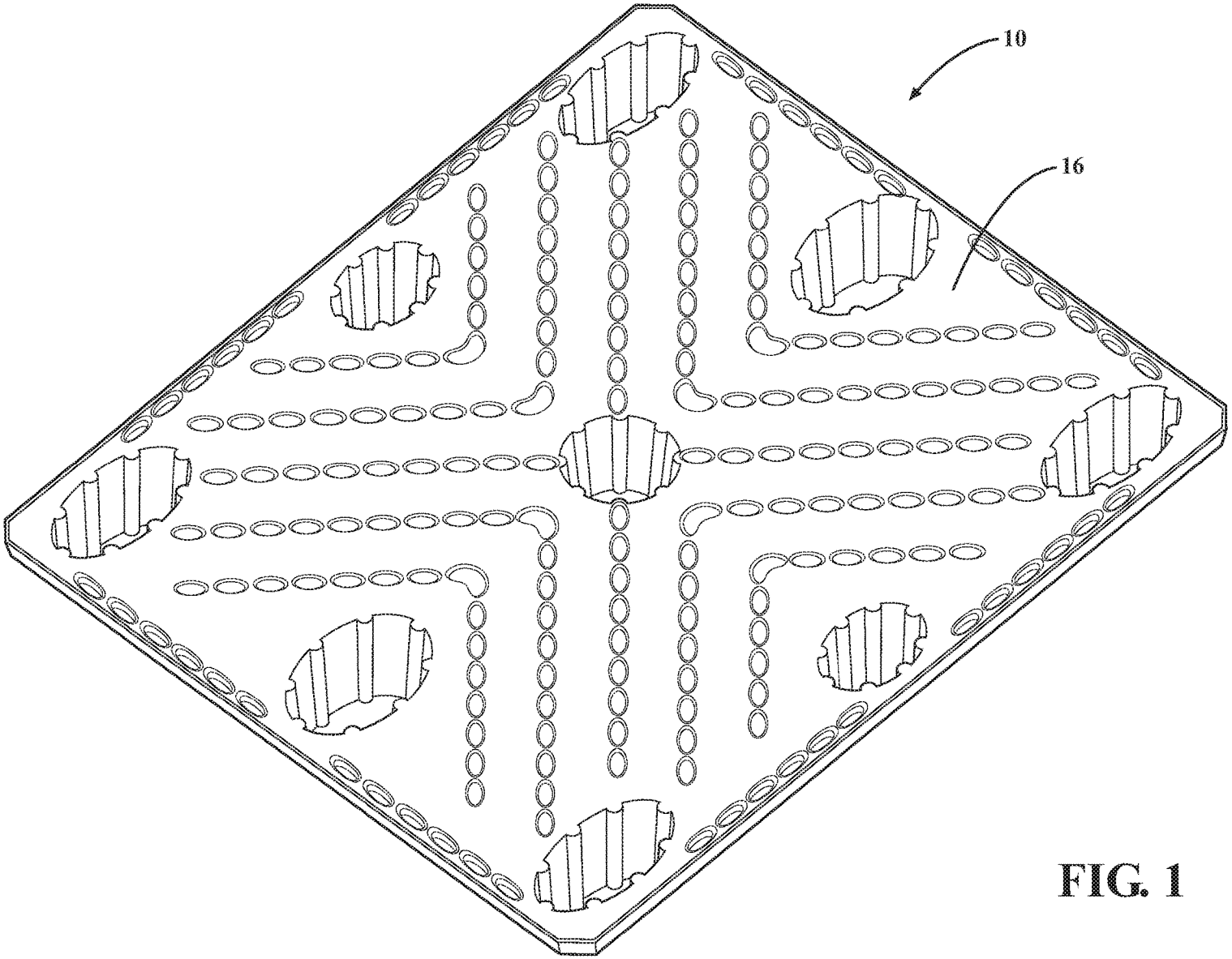
FIG. 1 is a perspective view of the top surface of a twin sheet thermoformed pallet taken from U.S. Pat. No. 5,950,545.

FIG. 1 shows an exemplary twin sheet molded plastic pallet 10 in perspective view. This drawing is taken from issued U.S. Pat. No. 5,950,545, issued Sep. 14, 1999; the inventor is Lyle H. Shuert. The pallet has a generally planar top loading surface 16, a bottom surface which does not show in FIG. 1 and nine thermoformed pallet legs 18 which afford four-way entry of a forklift for handling purposes. This particular twin sheet pallet is merely representative of a variety of molded plastic pallets that can be used in connection with the invention disclosed herein. The important factor is that the pallet structure has a depth between the bottom surface and the top loading surface to accommodate a recess for a signal device. This depth may, for example, be about 1½ to 3 inches. The thickness of the transponder is less than the recess depth.

Figure 2:
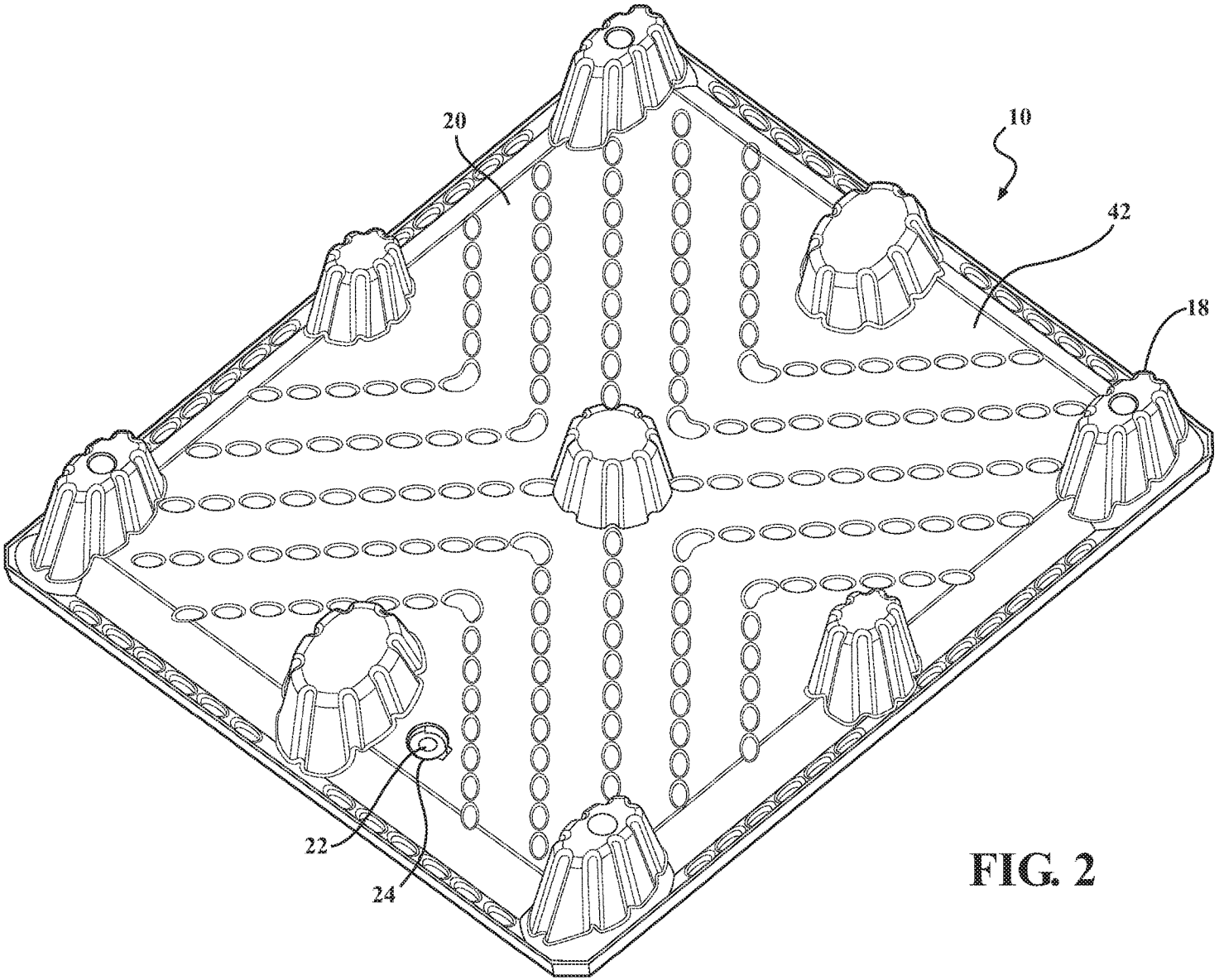
FIG. 2 is a perspective view of the bottom surface of the pallet of FIG. 1 showing the recess in the bottom surface with a GPS transmitter/transponder fitted therein.
Figure 7:
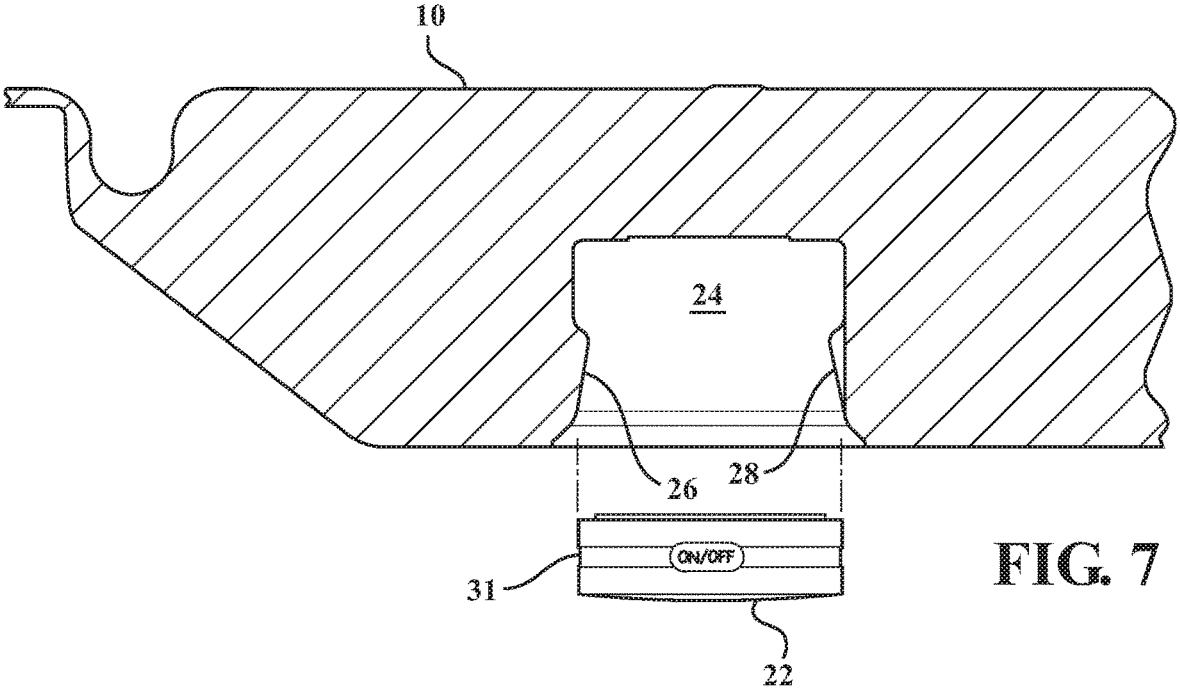
FIG. 7 is a schematic drawing of the pallet recess showing schematically how a grooved GPS transmitter is snapped into place within the recess.

FIG. 2 shows the bottom surface 20 of the nine-legged pallet to include thermoformed therein a general circular deep recess 24 shaped and sized to receive a generally disk-shaped, battery-powered signal transmitter/transponder 22 therein. In this case, the transmitter 22 is a GPS transmitter/transponder with a circular shape but can be any of a variety of other signal sources capable of sending RF signals representing such information as location, temperature and other metrics or conditions. As shown in FIGS. 2 and 7, the recess 24 is deep enough that the exposed surface of the transmitter/transponder is above the bottom surface of the pallet 10. The location is arbitrary, but it is preferably in a smooth generally planar surface away from the bosses shown in FIG. 2 and the adjacent legs.

Figure 3:
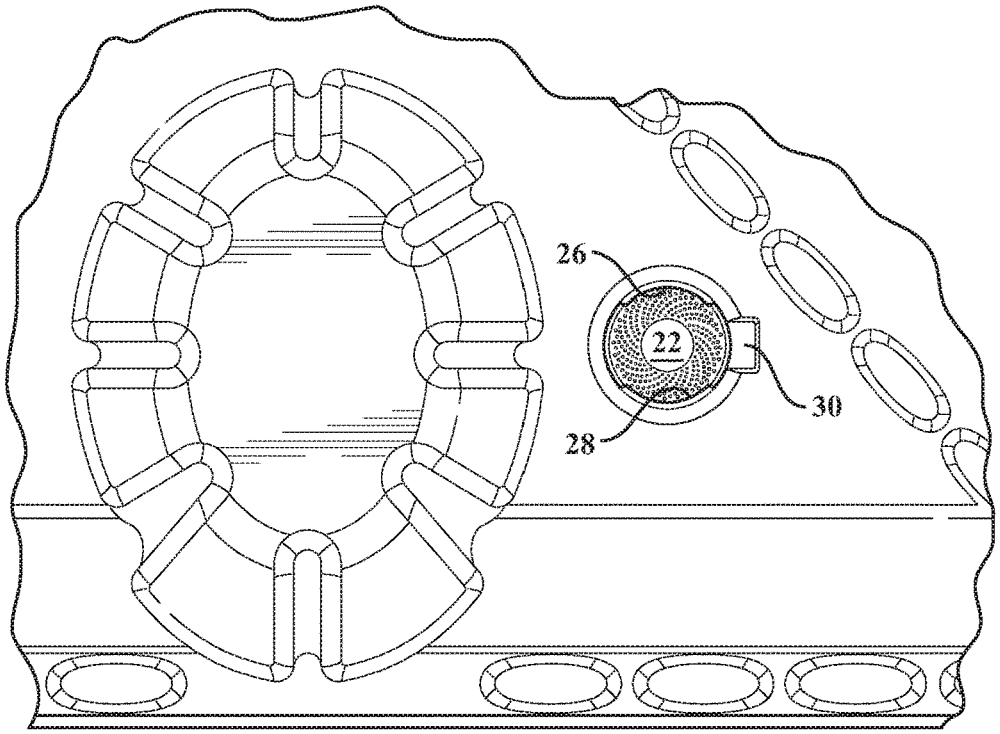
FIG. 3 is a close-up view of the pallet bottom from FIG. 2 showing the undercuts in the recess side wall and the lateral extension for removal purposes in greater detail.
Figure 4:
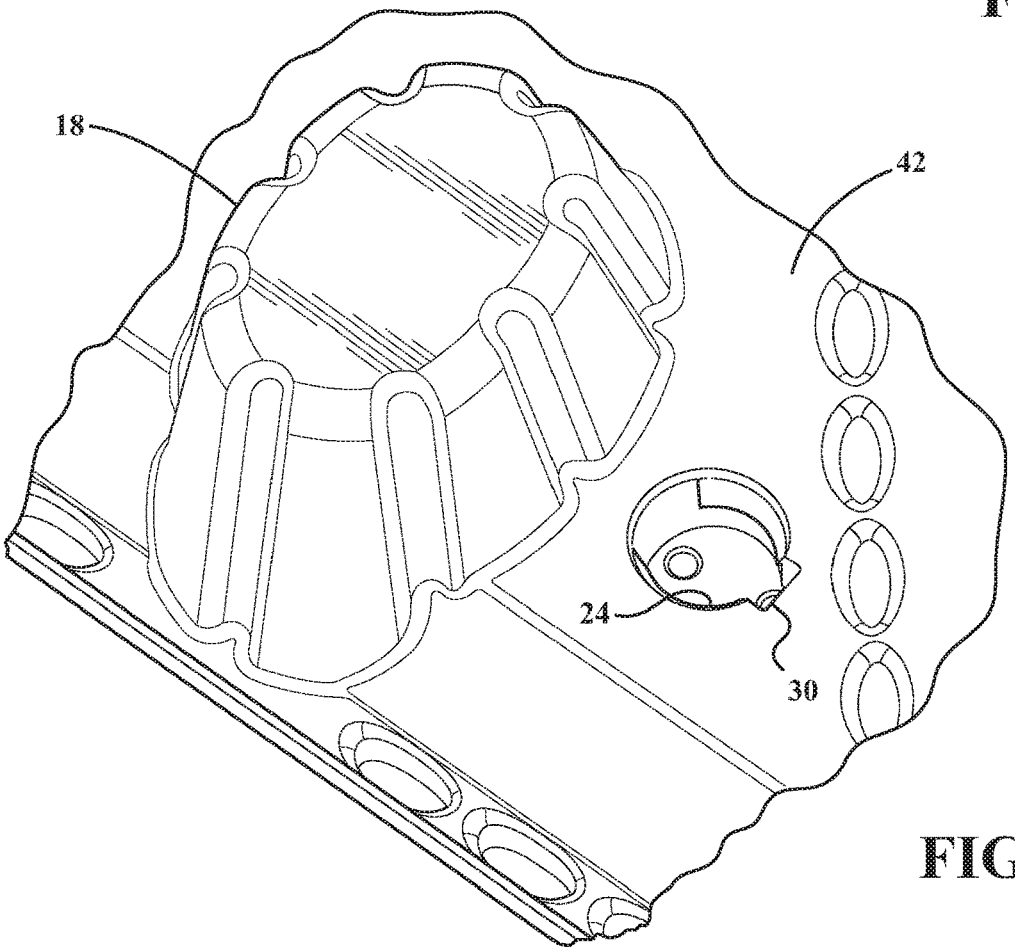
FIG. 4 is a close-up of the pallet bottom showing the empty recess and the depth thereof.

Referring to FIGS. 3 and 4, the shape and depth of the recess 24 is shown in detail to include a generally circular side wall having diametrically opposed circumferential and non-continuous arcuate undercut snap tabs 26 and 28 formed therein. In addition, a lateral extension 30 of the recess side wall 24 is formed in the recess between the undercuts to provide clearance for any external protuberances on the side surface of the transmitter/transponder 22 and to allow access for a pry tool to pry the transmitter/transponder 22 from the recess for recovery and/or servicing purposes. Again, the circular shape is shown by way of example rather than by way of limitation.

Figure 5:
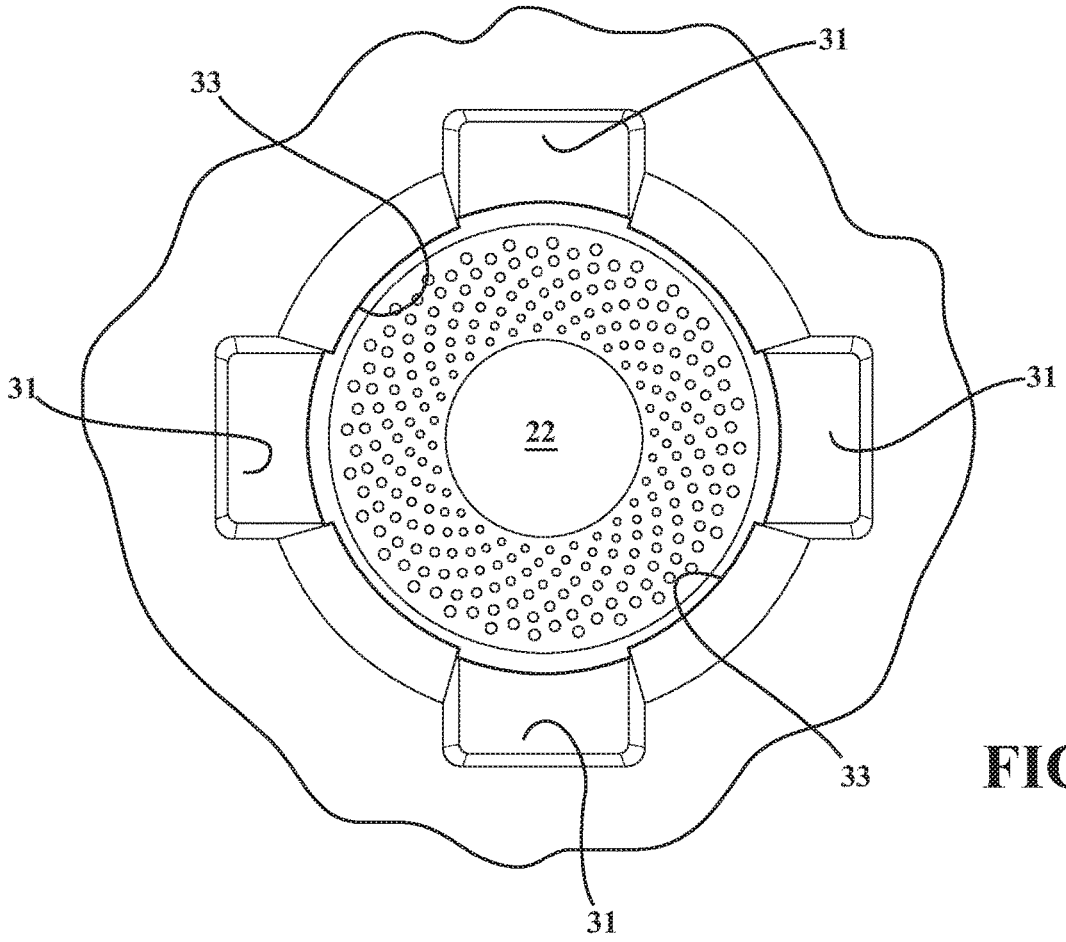
FIG. 5 shows another pallet bottom with an alternative configuration for the GPS receiving recess, this recess having four lateral extensions for removal of the transmitter.

FIG. 5 shows an alternative embodiment in which the cavity is formed with four lateral extensions 31 and at least two undercuts 33 to provide access for a user's fingers or a pry tool for removal of the GPS device.

Figure 6:
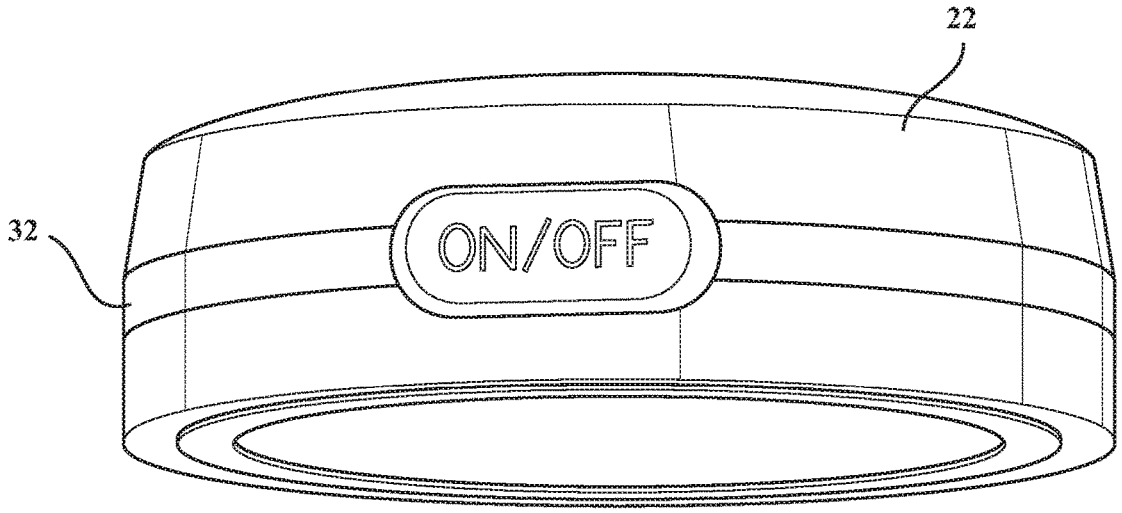
FIG. 6 is an image of a disk-shaped transmitter/transponder suitable for use in the apparatus of FIGS. 1-5.

FIG. 6 shows a representative commercially available GPS transmitter/transponder 22. While shown as circular with a circumferential, "belt line" 32, the shape of the device is arbitrary and can be square or rectangular, the recess being shaped to correspond to the shape of the device.

FIG. 7 is a schematic drawing of a recess 24 in the thermoformed plastic pallet 10 showing the undercut snap tabs 26 and 28. FIG. 7 also shows the circular outer wall 32 of the GPS device 22.

Figure 8:
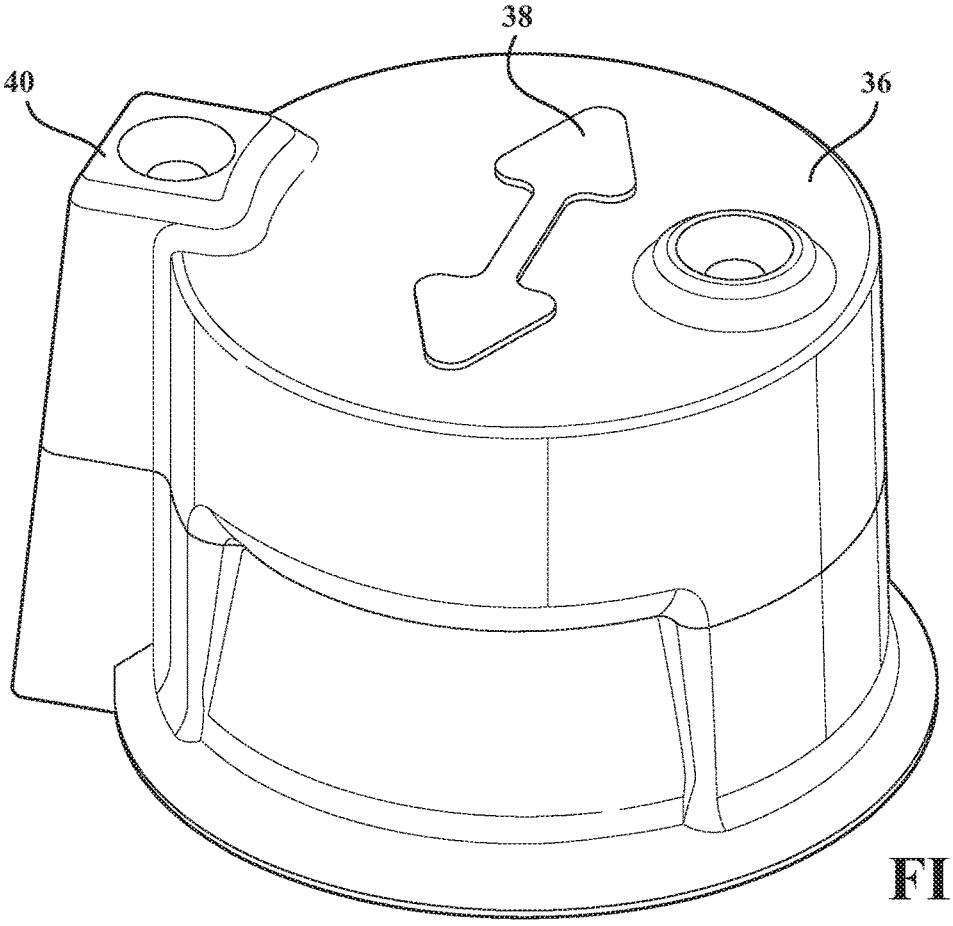
FIG. 8 is a rendering of a thermoforming insert which is used to modify a thermoforming mold so as to form the cavity of FIGS. 1-4 in the pallet bottom.

FIG. 8 is an illustration of an insert 36 which is placed in the mold structure in the thermoforming process to form the recess in the bottom of what would otherwise be a conventional twin sheet pallet. The embossed arrow 38 creates a guide in the final molded article to indicate the extrusion direction of the plastic sheet material that was used in the thermoforming process to form the twin sheet pallet. The extension 30 in the recess is formed by an appendix 40 on the side of insert 36.

Summarizing, the insert 36 is used in the thermoforming process for the production of a twin sheet thermoformed nine-legged plastic pallet to form a deep recess in the bottom surface of the pallet of a shape and depth to receive the battery-operated signaling device in the form of a GPS/transponder. Undercuts in the recess allow the device to be snapped into the recess with the exposed surface of the transmitter/transponder below the bottom surface of the pallet to prevent damage to the device during transportation and handling of the pallet and the associated load.

The transmitter/transponder is battery operated and preferably requires no external antenna wires. It may be activated by a signal to transmit, for example, an omni-directional GPS signal containing the coordinates of the location of the transmitter/transponder and the pallet into which the device is installed. With this arrangement, the location of the pallet can be determined at all times whether it be in a warehouse or other locations, loaded or unloaded, or in a transportation medium enroute to an assigned destination. The transmitter can be easily snapped into place without the use of tools and removed by a simple prying operation.

Figure 9:
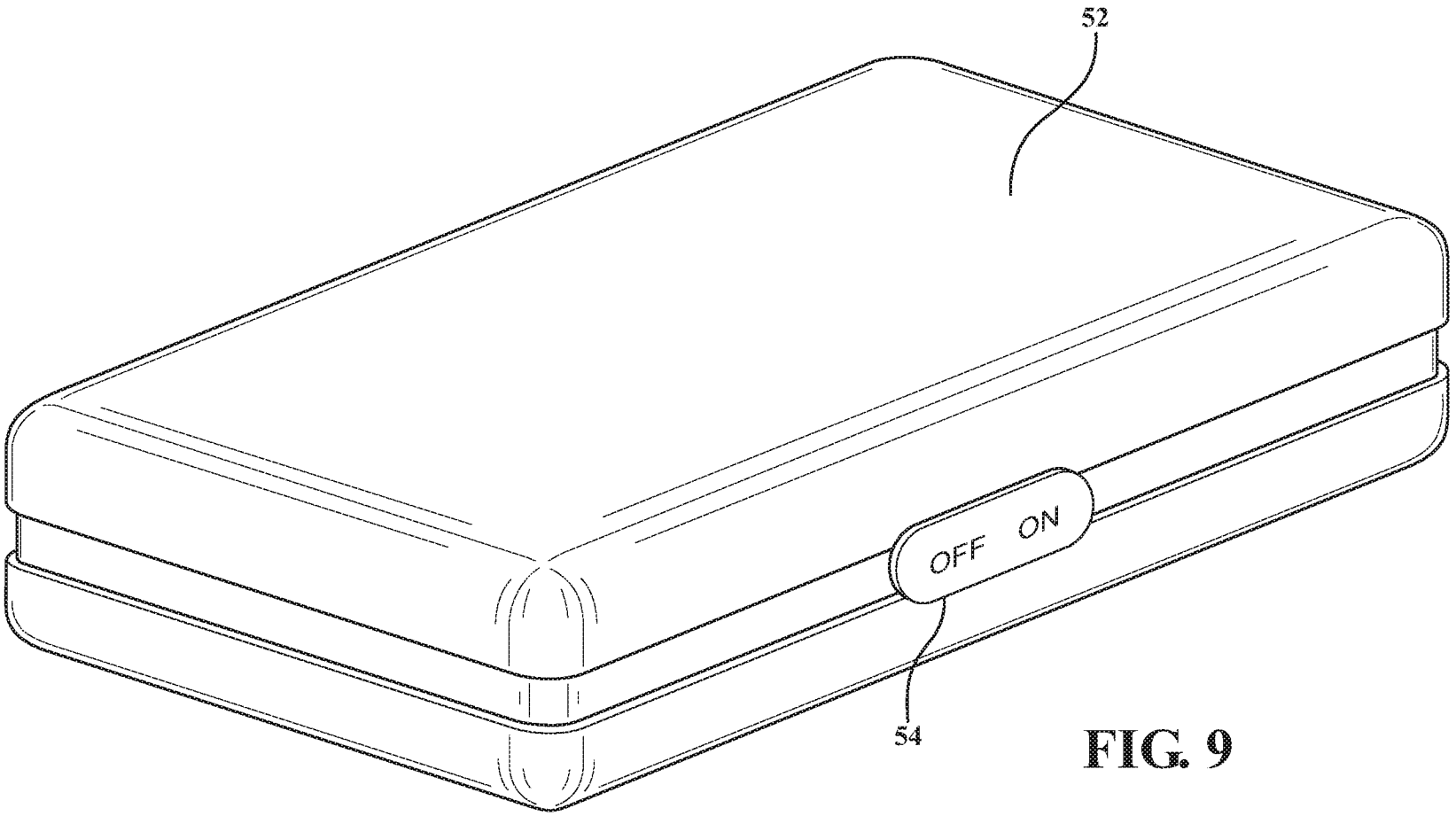
FIG. 9 is a perspective view of a rectangular GPS transponder.

Referring now to FIG. 9, there is shown a GPS transponder 52 of generally rectangular configuration with an off/on switch 54.

Figure 10:
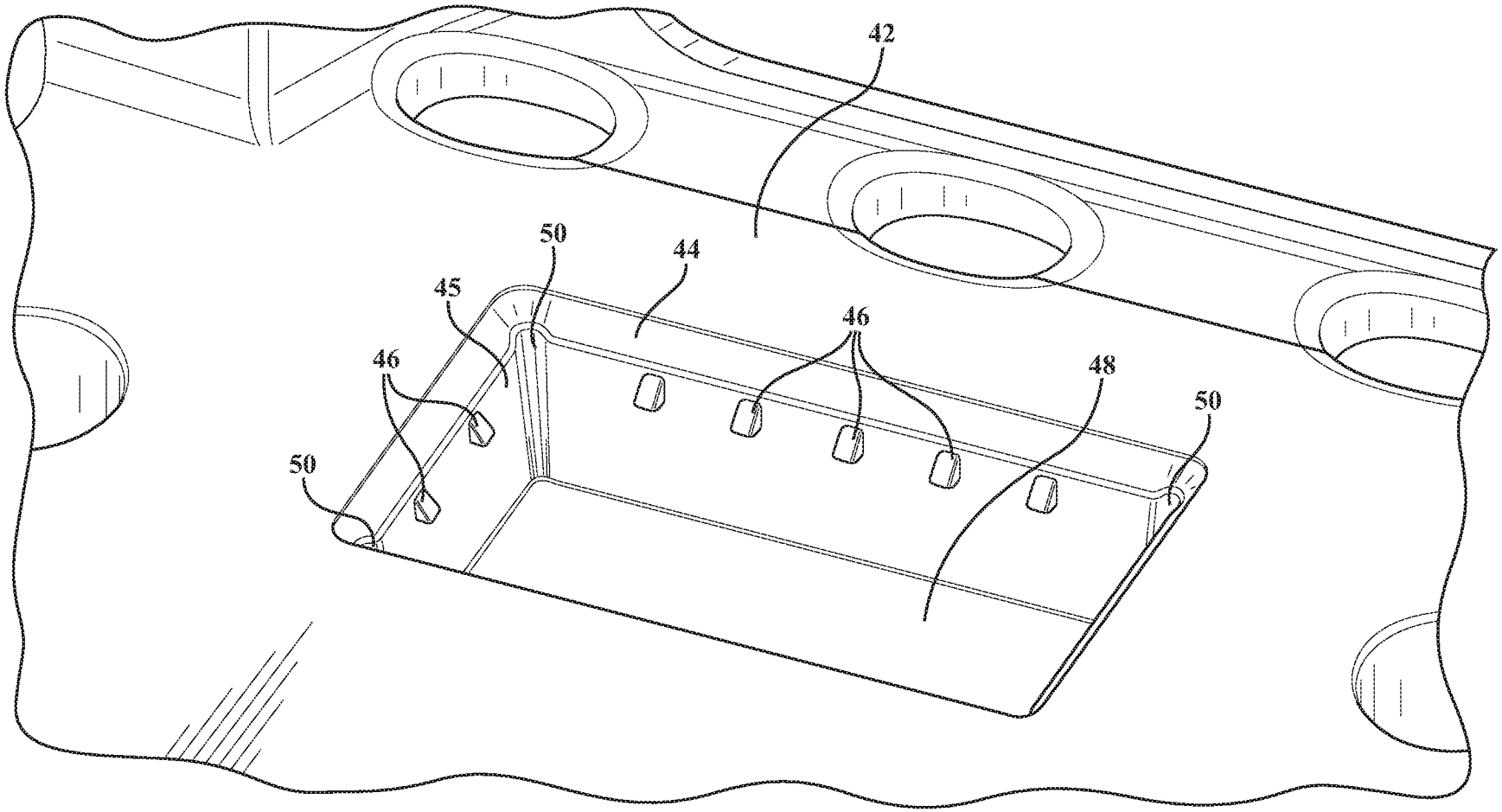
FIG. 10 is perspective view of the bottom of an inverted pallet showing the details of the recess with its retainer tabs and pry tool access slots for the rectangular transponder of FIG. 9.

FIG. 10 shows the pallet bottom in inverted orientation with a recess formed therein during the thermoforming process to receive the rectangular GPS transponder 52 of FIG. 9. The recess has a peripheral rim 44 which tapers toward the walls 45 of the recess, and a flat bottom 48 integral with all four of the recess walls.

Figure 11A:
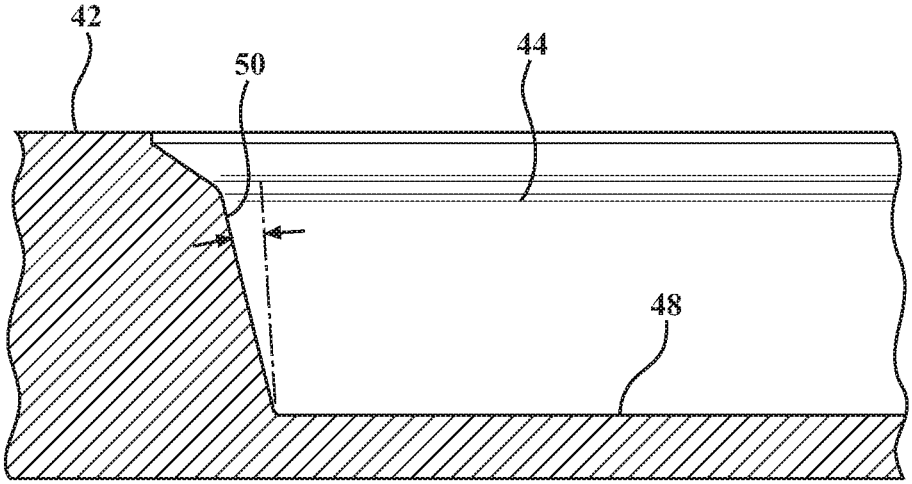
FIG. 11A is a detail of the pry tool access slot found in each corner of the recess for the rectangular GPS transponder.
Figure 11B:
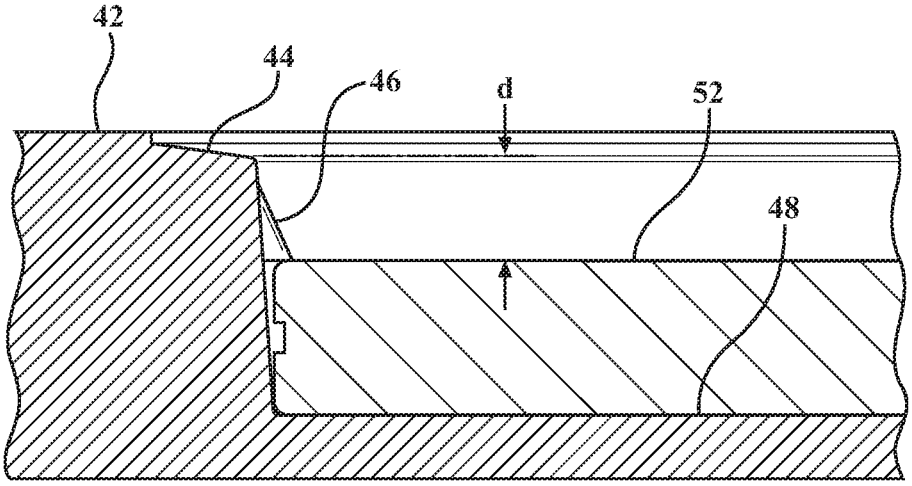
FIG. 11B is a detail of the recess showing the configuration of a retainer tab with undercut, again in inverted orientation.

Formed on the recess walls 45 are retainer tabs 46, also shown in FIG. 11B. The tabs have tapered outer surfaces to allow the transponder 52 to slide over the tabs and fully into the recess against the floor 48 but have top edges or undercuts to bear against the exposed surface of the transponder 52 as shown in FIG. 11B to hold the transponder in place against the bottom 48 once it has been fully inserted into the recess. The dimensions of the tabs 46 are such as to create a distance d between the top exposed surface of the transponder 52 and the pallet bottom 42 thereby to protect the transponder against damage during use.

Also formed into the recess are corner slots 50 with a semi-rounded wall which tapers at an angle between about 5° and 15° into and toward the bottom wall 48 of the recess so as to allow angled entry of a pry tool such as a screw driver into the recess where it can engage a corner of the transponder 52 and pry or lift the transponder out of the recess for replacement or service.

Figure 12:
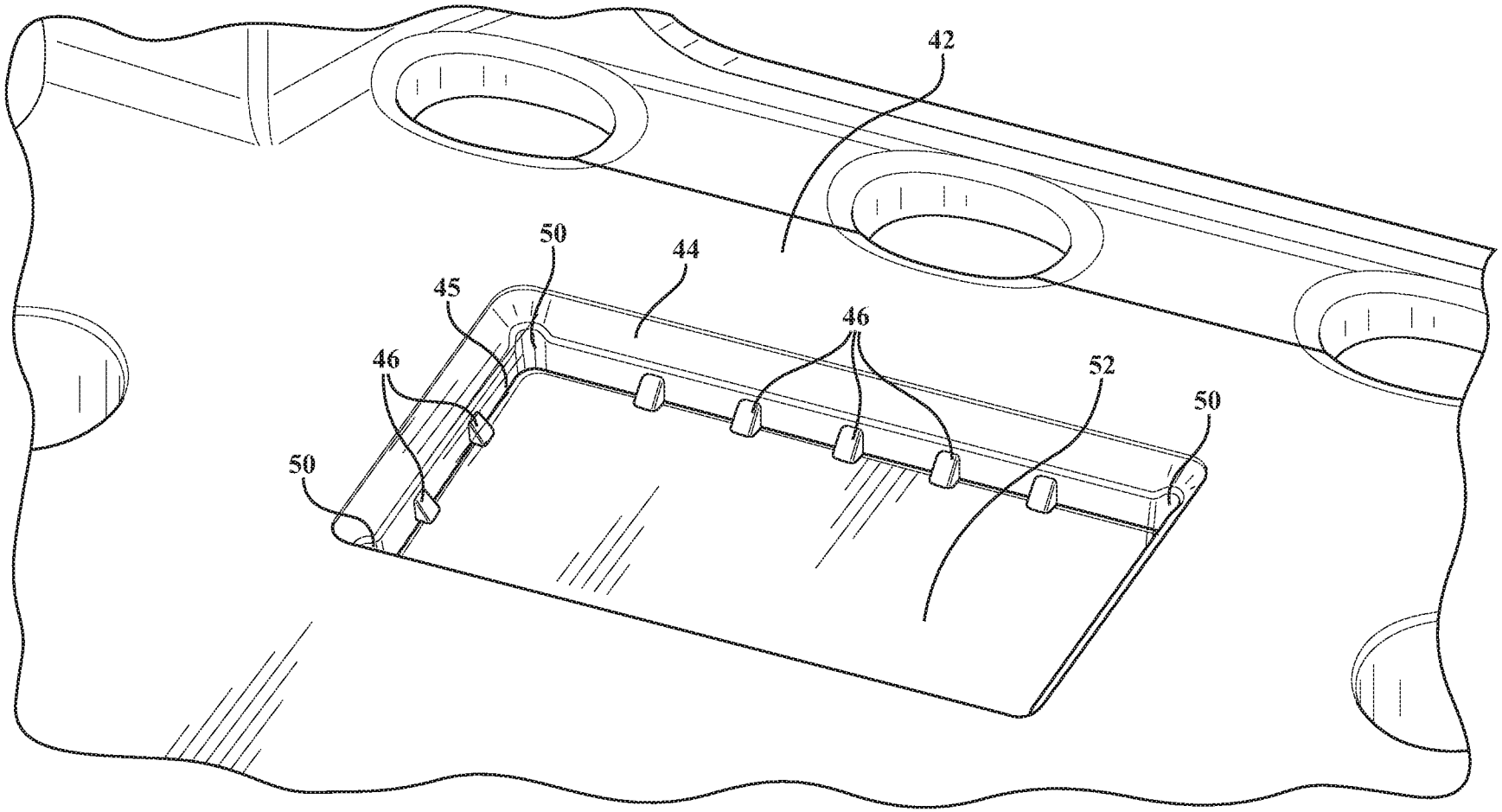
FIG. 12 is a view of the rectangular GPS transponder fully inserted into the rectangular recess in the pallet bottom.

FIG. 12 show the GPS transponder 52 fully inserted into the recess so as to snap above the undercuts on the retainer tabs 46 and well above the bottom surface 42 of the pallet. The transponder 52 is held in place by tabs 46 on all four of the walls of the rectangular recess shown in FIGS. 10 and 12.

It is to be understood that the invention has been illustrated and described with respect to illustrative embodiments and the that various modifications and changes to the invention may be made without departing from the spirit and scope of the invention as defined by the claims.

What is claimed:

1. In combination:

a molded plastic pallet having a top load-carrying surface and bottom surface with integral legs extending therefrom;

an internally-walled recess having a peripheral shape formed in the pallet and opening to the bottom surface thereof for installation and removal of a signaling device;

the recess having one or more walls and an interior surface at a predetermined depth and, on said walls, a plurality of retainer tabs with undercuts formed thereon;

the recess having a shape substantially conforming to a battery-operated information signaling device;

the combination further comprising a battery operated signaling device having a body with a peripheral shape substantially corresponding to the peripheral shape of said recess and of a thickness which is less than the depth of the recess so as to allow the signaling device to snap into place over the retainer tabs such that the undercuts hold the signaling device wholly above the bottom surface of the pallet to protect the device from damage during use of the pallet.

2. The combination defined in claim 1 wherein the signaling device is disk-shaped and the peripheral shape of the recess is generally cylindrical.

3. The combination defined in claim 1 wherein the undercuts are two in number and are uniformly and diametrically opposed to one another.

4. The combination defined in claim 1 wherein the number of retainer tabs with undercuts is four and said four undercuts are circumferentially spaced so as to provide peripheral spaces between them, and at least one extension extending from the recess between the undercuts for entry of pry tool.

5. The combination defined in claim 1 wherein the pallet is of twin-sheet construction.

6. The combination defined in claim 1 wherein the signaling device is a GPS transmitter.

7. A combination as defined in claim 1 wherein the signaling device has a rectangular shape and the recess in the pallet bottom has a corresponding rectangular shape, the retainer tabs being formed on side walls of the rectangular recess.

8. The combination defined in claim 1 wherein the signaling device is a GPS transponder.

9. A thermoformed twin sheet plastic pallet having a bottom surface and a recess formed in the bottom surface for insertion and removal of a transponder, said recess having one or more side walls and a floor to receive and hold therein a signaling device, each side wall of the recess being formed with a plurality of retainer tabs having sloped outer surfaces and undercuts which allow the device to be snapped in place into the recess in the pallet bottom surface and are held against said floor, the retainer tabs being tapered in the insertion direction to permit insertion of the device into the recess and held on the undercuts of the retainer tabs and spaced above the bottom surface of the pallet.

10. A pallet as defined in claim 9 wherein the recess has at least one lateral extension with a sloped wall to permit insertion of a pry tool to remove an installed signaling device.

11. A method of making a thermoformed pallet with a bottom surface and capable of removably carrying a signal transmitting device comprising the steps of:

(a) placing an insert in a thermoforming mold configured to produce a recess with walls of a predetermined depth in the bottom surface of a twin-sheet pallet formed in said mold; said insert forming retainer tabs on the recess walls, (b) thermoforming a twin-sheet pallet within said mold and around said mold insert so as to create said recess and, thereafter, (c) snapping a signal transmitting device into said recess wherein the device has a thickness less than the depth of said recess such that the device is held in said recess by said tabs above the bottom surface of the pallet.

* * * * *